US008609602B2

(12) United States Patent
Travis et al.

(10) Patent No.: US 8,609,602 B2
(45) Date of Patent: Dec. 17, 2013

(54) CLEANING SOLUTION

(75) Inventors: Benjamin R. Travis, Maumee, OH (US); Ritesh Mittal, Sylvania, OH (US); Seth M. Huff, Monroe, MI (US); Lijun M. Huang, Waterville, OH (US); Liang Tang, Waterville, OH (US)

(73) Assignee: Anatrace Products, LLC, Maumee, OH (US)

( * ) Notice: Subject to any disclaimer, the term of this patent is extended or adjusted under 35 U.S.C. 154(b) by 17 days.

(21) Appl. No.: 13/183,282

(22) Filed: Jul. 14, 2011

(65) Prior Publication Data

US 2012/0015862 A1 Jan. 19, 2012

Related U.S. Application Data

(60) Provisional application No. 61/364,347, filed on Jul. 14, 2010.

(51) Int. Cl.

| | |
|---|---|
| ***C11D 1/75*** | (2006.01) |
| ***C11D 3/26*** | (2006.01) |
| ***C11D 3/43*** | (2006.01) |
| ***C11D 3/44*** | (2006.01) |

(52) U.S. Cl.

USPC ..... 510/185; 510/188; 510/191; 510/238; 510/433; 510/435; 510/436; 510/503; 510/505; 510/506; 510/509

(58) Field of Classification Search

USPC ..... 510/185, 188, 191, 238, 421, 426, 432, 510/433, 435, 436, 503, 505, 506, 509; 134/42

See application file for complete search history.

(56) References Cited

U.S. PATENT DOCUMENTS

| | | | | |
|---|---|---|---|---|
| 3,664,961 | A | 5/1972 | Norris | |
| 4,264,479 | A * | 4/1981 | Flanagan | 8/137 |
| 5,405,617 | A | 4/1995 | Gowan, Jr. et al. | |
| 5,726,141 | A * | 3/1998 | Ofosu-Asante | 510/220 |
| 6,159,916 | A * | 12/2000 | Robbins et al. | 510/238 |
| 6,660,706 | B1 * | 12/2003 | Koester et al. | 510/423 |
| 6,737,394 | B2 | 5/2004 | Shana'a et al. | |
| 7,220,358 | B2 | 5/2007 | Schacht et al. | |
| 7,569,532 | B2 | 8/2009 | Man et al. | |
| 7,611,588 | B2 | 11/2009 | Peitersen et al. | |
| 7,682,403 | B2 | 3/2010 | Gohl et al. | |
| 7,737,097 | B2 | 6/2010 | Freer et al. | |
| 2002/0082184 | A1 * | 6/2002 | Teasdale et al. | 510/392 |
| 2005/0065055 | A1 * | 3/2005 | Barnes | 510/421 |
| 2006/0105933 | A1 * | 5/2006 | Hayashi et al. | 510/421 |
| 2006/0128585 | A1 * | 6/2006 | Adair et al. | 510/383 |
| 2009/0111724 | A1 * | 4/2009 | Kaaret | 510/109 |

OTHER PUBLICATIONS

Bonne, D., "Clean-in-place technology for improved ROI," World Pumps, vol. 2007, No. 486, Mar. 2007, 36-37.

Bremer, P.J. et al., "Laboratory scale Clean-In-Place (CIP) studies on the effectiveness of different caustic and acid wash steps on the removal of dairy biofilms," International Journal of Food Microbiology, vol. 106, No. 3, 2006, 254-262.

Gatti, R. et al., "Analysis of aliphatic dicarboxylic acids in pharmaceuticals and cosmetics by liquid chromatography (HPLC) with fluorescence detection," Journal of Pharmaceutical & Biomedical Analysis, vol. 13, No. 415, 1995, 589-595.

Opala, G. et al., "The Effect of Valproic Acid on Plasma Carnitine Levels," American Journal of Diseases in Children, vol. 145, No. 9, 1991, 999-1001.

"Source Direct launches low-foam/non-toxic industrial cleaner," Focus on Surfactants, vol. 2004, No. 10, Oct. 2004, p. 5.

Consumer Product Safety Commission, "Hazardous Substances and Articles; Administration and Enforcement Regulations," 16 C.F.R. 1500, 1997.

Environmental Protection Agency, "Labeling requirements," 40 C.F. R. 162.10, 1977.

Organisation for Economic Co-Operation and Development, "Acute Oral Toxicity," OECD Guideline for Testing of Chemicals No. 401, 1987.

* cited by examiner

*Primary Examiner* — Gregory Delcotto
(74) *Attorney, Agent, or Firm* — Pearne & Gordon LLP

(57) ABSTRACT

Disclosed are cleaning solutions. More particularly, non-toxic solutions of base, water, alcohol and detergent, that effectively and surprisingly eliminate contaminating aliphatic acids in aqueous solutions. When present as a foam or even a contaminating film remaining on various parts and surfaces, aliphatic acid contaminants can be present a large and costly problem in manufacturing operations, cleaning tasks, personal hygiene. The need to remove such contaminants arises in a myriad environments and situations, such as during the manufacture of detergents, pharmaceuticals, consumer products, coring and core analysis, manipulation of oils, fuels, fermentation applications, manufacture of emollients, moisturizers, liquors, foods such as seafood, milk, butter and other dairy products, water processing, paper products, tissue culture, reusable clinical equipment, and the like. Presented are cleaning compositions and methods that effectively eliminate and prevent build up of such dangerous and costly contaminants in aqueous solutions.

25 Claims, No Drawings

CLEANING SOLUTION

RELATED APPLICATIONS

The present application claims priority to U.S. Provisional Patent Application Ser. No. 61/364,347, filed on Jul. 14, 2010, the entire disclosure of which is incorporated herein by reference for all purposes.

FIELD OF THE INVENTION

A cleaning solution is provided which may be applied in a variety of settings, including clean-in-place situations, pharmaceutical industry, academia, food processing, fermentation, home use, consumer products, detergents, hospitals and other situations in which removal of aliphatic acid contaminants is required. The solution components are non-toxic and exhibit remarkable ability to solubilize aliphatic acids, such as fatty acids.

BACKGROUND OF THE INVENTION

When aliphatic acids, such as fatty-acids, are suspended in aqueous solutions, stable foams can form on the surface. Stable foams can present a serious problem in many fields, such as industry, or chemical manufacturing. Stable foams can foul machinery and exist as residues and contamination on surfaces. Foams may be created in liquid handling when seals on pumps are leaky, low efficiency pumps leading to cavitation, bacterial growth, dirt contamination, systems are not designed properly, consistent pressure is not maintained within the system, and the like. Air can then enter into the system and become dissolved in the liquid, be entrained into the liquid causing bubbles to collect at the surface, and bubbles which rise to the surface and become foam. Such problems can lead to the need to perform costly repairs of instrumentation, cleaning of tanks and vessels or vats, cleaning of sieves and filters, and loss of production due to inconsistency of formulation. Such contaminating acids, present in foams or gels, can present significant cleaning problems since they are difficult to remove from surfaces and parts.

Aliphatic acids such as fatty acids, are carboxylic acids with a variable length, branched or unbranched aliphatic chain (tail). The tail may be saturated or unsaturated. Most naturally occurring fatty acids possess a chain of 4 to 30 carbon atoms. Fatty acids may be produced a number of ways, for instance by hydrolysis of the ester linkages in a fat or oil (triglycerides) with the removal of glycerol. Fatty acids can be troublesome side products of industry-scale chemical production methods, such as methods for producing detergents, pharmaceuticals, consumer products, coring and core analysis, oils, fuels, fermentation, emollients, moisturizers, liquors, foods such as seafood, milk, butter and other dairy products, water processing, paper products, and the like. Fatty acids may also be present in various consumer products, such as gels, soaps, or other fluids and can contaminate parts, machines, or other surfaces which come into contact with these products.

The "clean in place," or CIP, industry has developed many methods for removing contaminants from machinery, vessels, equipment, and the like. Typically such methods call for several cycles of washing and rinsing wherein a cleaning solution is recycled through the system components to achieve solubilization and removal of the undesirable contaminants. (See, for instance, Bremer et al., *Int'l. J. Food Microbio.,* 106:254-262, 2006).

Furthermore, there exist in the field many varied compositions which are directed to removing foam or preventing the generation of foam, commonly referred to as anti-foaming agents or defoamers. A defoamer is a chemical additive that reduces and hinders the formation of foam in industrial process liquids. Such chemical solutions are commonly employed in industrial settings to increase speed and reduce fouling of instruments and machinery. Such solutions are capable, in certain contexts, of reducing or eliminating surface foam and entrained, or entrapped, air in liquids. Defoamers can be generally categorized as oil-based, powder-based, water-based, silicone-based, glycol-based and alkyl polyacrylates. Defoamers are commonly used in the manufacturing of specialty detergents, carbonated beverages, fermentation, wood pulp and paper manufacturing, and in the pharmaceutical industry during capsulation.

Other caustic and hazardous cleaning solutions are known, such as provided, for instance, in U.S. Pat. Nos. 7,220,358, 7,569,532, 7,611,588, 6,737,394, 7,737,097 and 7,682,403, all of which are incorporated herein by reference in their entireties for all purposes. Though there are many varieties of cleaning solutions available on the market, there are no known solutions available which specifically solubilize aliphatic acids, such as fatty acids and derivatives thereof, especially cleaning solutions which are relatively non-toxic, non-caustic and not hazardous to handle, such that they may be useful in consumer products.

Among other aspects, the present invention provides methods and compositions that overcome the above noted limitations and permit rapid, simple, and effective removal and/or prevention of foams generated in solution by contaminating aliphatic acids, such as fatty acids. A complete understanding of the invention will be obtained upon review of the following.

SUMMARY OF THE INVENTION

Described are cleaning solutions which contain a base, an alcohol, a detergent, and water. The cleaning solutions compositions are effective in eliminating, preventing, solubilizing and/or capturing contaminating aliphatic acids in solution and left behind on surfaces. The cleaning solution compositions are non-toxic, non-caustic and relatively inexpensive compared to other cleaning solutions. The base of the cleaning composition may be selected from ammonium or alkali metal (sodium, potassium, magnesium and the like) bases and bases comprising phosphate, carbonate, bicarbonate, and/or borate, and combinations thereof and mixtures thereof. The alcohol may be a short-chain primary alcohol, such as a $C_1$ to $C_8$ alcohol, linear primary alcohol or branched secondary or tertiary alcohol. The detergent of the present compositions may be n-dodecyl-N,N-dimethylamine-N-oxide (LDAO) or similar detergents including zwitterionic surfactants, amine oxides and the like. Other detergents that may be useful in the present compositions include, but are not limited to, water-soluble or water-dispersible nonionic, semi-polar nonionic, anionic, cationic, and amphoteric surface-active agents, and any combinations or mixtures thereof. Thus, the cleaning compositions may be comprised of, for instance, isopropyl alcohol (IPA), TRIZMA® (or tris base) and LDAO. The alcohol, base and detergent may be mixtures of one or more alcohols, bases and/or detergents.

The cleaning solution compositions contain detergents which are present in at a concentration of between about 0% and 10% (w/v). The percent alcohol present in the cleaning solution may be between about 0% and 40% (w/v). The percent base present in the cleaning solution may be between about 0% and 5% (w/v).

Additionally disclosed are methods of eliminating or otherwise removing an aliphatic acid from an aliphatic acid-contaminated solution or surface, which comprises adding, or contacting, the present cleaning solution compositions to the aliphatic acid-contaminated solution, or with the surface, respectively. Also described are methods of eliminating an aliphatic acid contaminant by contacting a contaminated surface, or adding to a contaminated aqueous solution, the present cleaning solution compositions. The method may further include a step of first spiking another cleaning solution with the present compositions, thereby enhancing or adding to the "old" cleaning a solution a new or additional functionality of being able to eliminate, remove or otherwise solubilize aliphatic acid contaminants. The amount of the present cleaning solution compositions to add to the "old" cleaning solution may be determined empirically to achieve the optimum additional functionality of elimination of aliphatic acid contaminants.

DEFINITIONS

Unless defined otherwise, all technical and scientific terms used herein have the same meaning as commonly understood by one of ordinary skill in the art to which the invention pertains. The following definitions supplement those in the art and are directed to the current application and are not to be imputed to any related or unrelated case, e.g., to any commonly owned patent or application. Although any methods and materials similar or equivalent to those described herein can be used in the practice for testing of the present invention, the preferred materials and methods are described herein. Accordingly, the terminology used herein is for the purpose of describing particular embodiments only, and is not intended to be limiting.

As used in this specification and the appended claims, the singular forms "a," "an" and "the" include plural referents unless the context clearly dictates otherwise. Thus, for example, reference to "a molecule" includes a plurality of such molecules, and the like.

The term "about" as used herein indicates the value of a given quantity varies by +/−10% of the value, or optionally +/−5% of the value, or in some embodiments, by +/−1% of the value so described.

The term "aliphatic acid" as used herein means any acid attached to an organic compound defined by carbon atoms which form branched or straight, open carbon chains. Aliphatic acid is meant to also include all degrees of acid, such as dicarboxylic acids and tricarboxylic acids.

The term "fatty acid" as used herein refers to $C_4$-$C_{30}$ fatty acids which may be saturated or unsaturated, and may have straight or branched alkyl chains. Fatty acids are defined by a carboxylic head group attached to a carbon chain of $C_4$-$C_{30}$ in length. Examples fatty include, but are not limited to, pentanoic acid, hexanoic acid, heptanoic acid (enanthic acid), octanoic acid (caprylic acid), nonanoic acid (pelargonic acid), decanoic acid (n-capric acid), undecanoic acid, lauric acid, myristic acid, palmitic acid, stearic acid, oleic acid, linolenic acid, linoleic acid, erucic acid, palmitoleic acid, pentadecanoic acid, margaric acid, arachidic acid, arachidonic acid, behenic acid, and soya fatty acids, 2-hexyldecanoic acid, and mixtures thereof and the like.

As known in the art, an unsaturated fatty acid ester is the ester condensation product of an unsaturated fatty acid and an alcohol. The unsaturated fatty acid comprises an extended carbon chain containing at least one carbon-carbon double bond and terminating in a carboxylic acid group. Typically, the unsaturated fatty acid will contain greater than about 6 carbon atoms, greater than about 10 carbon atoms, or greater than about 12 carbon atoms. Typically, the unsaturated fatty acid will contain less than about 50 carbon atoms, less than about 36 carbon atoms, or less than about 26 carbon atoms. At least one carbon-carbon double bond is present along the carbon chain in an unsaturated fatty acid. This double bond usually occurs at about the middle of the chain, but not necessarily at this position. The unsaturated fatty acid may be straight chain or branched and substituted along the fatty acid chain with one or more substituents. Non-limiting examples of substituents include alkyl moieties, including for example methyl, ethyl, propyl, butyl, and the like; cycloalkyl moieties, including for example, cyclopentyl and cyclohexyl; monocyclic aromatic moieties, such as, but not limited to, phenyl; arylalkyl moieties, arylalkyl moieties, including, for example, benzyl; and alkylaryl moieties, including, for example, tolyl, ethylphenyl, xylyl, and the like; as well as hydroxyl, ether, keto, aldehyde, and halide, such as chloro and bromo, functionalities.

Non-limiting examples of unsaturated fatty acids that may be acted upon by the present compositions and methods include 3-hexenoic (hydrosorbic), trans-2-heptenoic, 2-octenoic, 2-nonenoic, cis- and trans-4-decenoic, 9-decenoic (caproleic), 10-undecenoic (undecylenic), trans-3-dodecenoic (linderic), tridecenoic, cis-9-tetradecenoic (myristoleic), pentadecenoic, cis-9-hexadecenoic (cis-9-palmitoleic), trans-9-hexadecenoic (trans-9-palmitoleic), 9-heptadecenoic, cis-6-octadecenoic (petroselinic), trans-6-octadecenoic (petroselaidic), cis-9-octadecenoic (oleic), trans-9-octadecenoic (elaidic), cis-11-octadecenoic, trans-1'-octadecenoic (vaccenic), cis-5-eicosenoic, cis-9-eicosenoic (godoleic), cis-1'-docosenoic (cetoleic), cis-13-docosenoic (erucic), trans-13-docosenoic (brassidic), cis-15-tetracosenoic (selacholeic), cis-17-hexacosenoic (ximenic), and cis-21-triacontenoic (lumequeic) acids, as well as 2,4-hexadienoic (sorbic), cis-9-cis-12-octadecadienoic (linoleic), cis-9-cis-12-cis-15-octadecatrienoic (linolenic), eleostearic, 12-hydroxy-cis-9-octadecenoic (ricinoleic), cis-5-docosenoic, cis-5,13-docosadienoic and like acids and mixtures thereof.

A non-limiting list of exemplary saturated fatty acids without additional substituents includes the following (common names provided in parentheses): propanoic acid (propionic acid), butanoic acid (butyric acid), pentanoic acid (valeric acid), hexanoic acid (caproic acid), heptanoic acid (enanthic acid), octanoic acid (caprylic acid), nonanoic acid (pelargonic acid), decanoic acid (capric acid), undecanoic acid (undecylic acid), dodecanoic acid (lauric acid), tridecanoic acid (tridecylic acid), tetradecanoic acid (myristic acid), pentadecanoic acid (pentadecylic acid), hexadecanoic acid (palmitic acid), heptadecanoic acid (margaric acid), octadecanoic acid (stearic acid), nonadecanoic acid (nonadecylic acid), eicosanoic acid (arachidic acid), heneicosanoic acid (heneicosylic acid), docosanoic acid (behenic acid), tricosanoic acid (tricosylic acid), tetracosanoic acid (lignoceric acid), pentacosanoic acid (pentacosylic acid), hexacosanoic acid (cerotic acid), heptacosanoic acid (heptacosylic acid), octacosanoic acid (montanic acid), nonacosanoic acid (nonacosylic acid), triacontanoic acid (melissic acid), henatriacontanoic acid (henatriacontylic acid), dotriacontanoic acid (lacceroic acid), tritriacontanoic acid (psyllic acid), tetratriacontanoic acid (geddic acid), pentatriacontanoic acid (ceroplastic acid), hexatriacontanoic acid (hexatriacontylic acid) and mixtures thereof.

The term "non-toxic" is meant to mean non-poisonous, non-hazardous, not composed of poisonous materials that could harm human health if exposure is limited to moderate quantities and not ingested. Non-toxic may also mean non-caustic, or does not leach plastic containers or leach plastic when in contact with plastic surfaces for a prolonged period of time, and does not etch surfaces such as plastic or metal over time. Non-toxic is meant to connote harmlessness to humans and animals in acceptable quantities if not ingested and even upon ingestion, does not cause immediate serious harmful effects to the person or animal ingesting the substance. The term non-toxic is not meant to mean able to be swallowed or injected or otherwise taken in by animals, plants, or other living organisms. The term non-toxic is not meant to imply not harmful to the environment, but may mean that due to its mildness it is not very harmful when disposed of in the usual manner in dilute form, i.e. through a sink drain or sewer system, and the like, and may mean the substance is classified as non-toxic by the Environmental Protection Agency (EPA) and the World Health Organization (WHO). For instance, the Material Safety Data Sheet (MSDS) for n-dodecyl-N,N-dimethylamine-N-oxide reports that the LD50 for this detergent is 5000 mg/kg. Short-chain alcohols are known to have similar or higher LD50 values, such as 7,060 mg/kg for ethanol and 29,700 mg/kg for sucrose. In general, an LD50 value of more than 5000 mg/kg is acceptable according to the FDA. For regulatory purposes, it is well known that any material with an LD50 greater than 2,000 mg/kg or 5,000 mg/kg is considered to be the highest dose necessary to test. (See, OECD, "Acute Oral Toxicity," Guideline 401, Paris: Organisation for Economic Co-operation and Development, 1987; Consumer Product Safety Commission, "Hazardous Substances and Articles," Administration and Enforcement Regulations, 16 C.F.R. §1500, 1997; FDA, "Toxicological Principles for the Safety Assessment of Direct Food Additives and Color Additives Used in Food," Redbook Draft, Washington, D.C., Food and Drug Administration, 1992; Environment Protection Agency, "Labeling requirements," 40 C.F.R. §162.10, 1977; Japanese MAFF, "Acute oral Toxicity Test," 59 NohSan #4200, Tokyo, Japanese Ministry of Agriculture, Forestry and Fisheries, 1985). Materials with LD50 values greater than these dose levels are considered to be virtually nontoxic. The term non-toxic is therefore not meant to mean non-irritant or not causing irritation when exposed to skin over prolonged periods of time or otherwise ingested.

A variety of additional terms are defined or otherwise characterized herein.

DETAILED DESCRIPTION

The present invention provides methods, compositions, and kits for solubilization of aliphatic acids, such as fatty acids and fatty acid esters, and derivatives thereof, which when present as a contaminant in solutions can cause the formation of damaging foams and biofilms in liquids.

A general class of embodiments includes compositions with remarkable ability to solubilize and therefore wash away or remove aliphatic acids. By aliphatic acids is meant any fatty acid, having a branched or straight chain, and being either saturated or unsaturated. Contaminating aliphatic acids may be present on solid surfaces as a film or foam, in aqueous solutions, or as a dry solid coating. The embodiments provided herein include compositions which may be used to wash or rinse parts, such as machine parts, disposable parts, consumer products, and the like, which have been contaminated with aliphatic acids and/or foams formed therefrom.

Detergents that may be useful in the present compositions and methods include, but are not limited to those provided below in Table 1. Other detergents that may be useful in the present compositions include, but are not limited to, water-soluble or water-dispersible nonionic, semi-polar nonionic, anionic, cationic, amphoteric, or zwitterionic surface-active agents, or any combinations or mixtures thereof. A listing of species of surfactants or detergents useful herein appears in U.S. Pat. No. 3,664,961, incorporated herein by reference in its entirety for all purposes. Further, U.S. Pat. No. 7,220,358, at column 20, line 55 to column 25, line 14 provides additional exemplary detergents and surfactants that may be useful in the present cleaning compositions (this section of U.S. Pat. No. 7,220,358 is specifically incorporated herein by reference in its entirety for all purposes).

TABLE 1

| Non-Limiting List of Exemplary Detergents | |
|---|---|
| 2-PROPYL-1-PENTYL-B-D-MALTOSIDE | HEGA-10, ANAGRADE |
| AMPHIPOL | HEGA-11, ANAGRADE |
| AMPICILLIN, SODIUM SALT | HEGA-8, ANAGRADE |
| ANAMEG-7, ANAGRADE (EQUAL HECAMEG) | HEGA-9, ANAGRADE |
| ANAPOE-20 (TWEEN 20) | IPTG, ANAGRADE |
| ANAPOE-35 (BRIJ-35) | IPTG, ANALYTICAL GRADE |
| ANAPOE-58 (BRIJ-58) | L-(+)-SELENOMETHIONINE, ANALYTICAL |
| ANAPOE-80 (TWEEN 80) | LAPAO, SOL-GRADE |
| ANAPOE-C10E6 | LYSOFOS CHOLINE ETHER 10 |
| ANAPOE-C10E9 | LYSOFOS CHOLINE ETHER 12 |
| ANAPOE-C12E10 | LYSOFOS CHOLINE ETHER 14 |
| ANAPOE-C12E8 | LYSOFOS CHOLINE ETHER 16 |
| ANAPOE-C12E9 | LYSOFOS CHOLINE ETHER 18 |
| ANAPOE-C13E8 | LYSOFOS GLYCEROL 10 |
| ANAPOE-CXEY | LYSOFOS GLYCEROL 12 |
| ANAPOE-NID-P40 | LYSOFOS GLYCEROL 14 |
| ANAPOE-TRITON/TWEEN | LYSOFOS GLYCEROL 16 |
| ANAPOE-X-100 | LYSOFOS GLYCEROL 18 |
| ANAPOE-X-114 | LYSOFOS-CHOLINE 10 |
| ANAPOE-X-305 | LYSOFOS-CHOLINE 12 |
| ANAPOE-X-405 | LYSOFOS-CHOLINE 14 |
| ANZERGENT | LYSOFOS-CHOLINE 16 |
| ANZERGENT 3-10, ANALYTICAL GRADE | LYSOFOS-CHOLINE 18 |
| ANZERGENT 3-12, ANALYTICAL GRADE | MALT(12-16) |
| ANZERGENT 3-14, ANALYTICAL GRADE | MALT(6-11) |
| ANZERGENT 3-16 ANALYTICAL GRADE | MEGA |

TABLE 1-continued

| Non-Limiting List of Exemplary Detergents | |
|---|---|
| ANZERGENT 3-18 ANALYTICAL GRADE | MEGA-10, ANAGRADE |
| ANZERGENT 3-8, ANALYTICAL GRADE | MEGA-8, ANAGRADE |
| BIG CHAP, ANALYTICAL GRADE | MEGA-9, ANAGRADE |
| BIG CHAP, DEOXY, ANALYTICAL GRADE | MTSEA |
| C10E5 ANAGRADE | MTSES |
| C10E6 ANALYTICAL GRADE | MTSET |
| C12E8 ANAGRADE | N-DECYL-A-D-MALTOSIDE, ANAGRADE |
| C12E8 ANALYTICAL GRADE | N-DECYL-B-D-GLUCOSIDE, ANAGRADE |
| C8E4 ANAGRADE | N-DECYL-B-D-MALTOSIDE, 95+ GRADE |
| C8E5 ANAGRADE | N-DECYL-B-D-MALTOSIDE, ANAGRADE |
| C8E6 ANAGRADE | N-DECYL-B-D-MALTOSIDE, SOL-GRADE |
| CARBENICILLIN DISODIUM SALT | N-DECYL-B-D-MALTOSIDE-LA, ANAGRADE |
| CHAPS, ANAGRADE | N-DECYL-B-D-THIOGLUCOSIDE, ANAGRADE |
| CHAPS, SOL-GRADE | N-DECYL-B-D-THIOMALTOSIDE, ANAGRADE |
| CHAPSO, ANAGRADE | N-DODECYL-A-D-MALTOSIDE, ANAGRADE |
| C-HEGA-10, ANAGRADE | N-DODECYL-B-D-GLUCOSIDE, ANAGRADE |
| C-HEGA-11, ANAGRADE | N-DODECYL-B-D-MALTOSIDE, SOL-GRADE |
| C-HEGA-8, ANAGRADE | N-DODECYL-B-D-MALTOSIDE, ANAGRADE |
| C-HEGA-9, ANAGRADE | N-DODECYL-B-D-MALTOSIDE-A, ANAGRADE |
| CHOBIMALT | N-DODECYL-B-D-MALTOSIDE-LA, ANAGRADE |
| CHOLESTEROL | N-DODECYL-B-D-THIOMALTOSIDE |
| CHOLESTERYL HEMISUCCINATE TRIS SALT | N-DODECYL-D25-B-D-MALTOPYRANOSIDE |
| CYCLOFOS-2, ANAGRADE | NDSB-195 |
| CYCLOFOS-3, ANAGRADE | NDSB-201 |
| CYCLOFOS-4, ANAGRADE | NDSB-211 |
| CYCLOFOS-5, ANAGRADE | NDSB-221 |
| CYCLOFOS-6, ANAGRADE | NDSB-256 |
| CYCLOFOS-7, ANAGRADE | N-HEPTYL-B-D-GLUCOSIDE, ANAGRADE |
| CYGLU-3, ANAGRADE | N-HEPTYL-B-D-THIOGLUCOSIDE |
| CYGLU-4, ANAGRADE | N-HEPTYL-B-D-THIOGLUCOSIDE, LA |
| CYMAL ®-1, ANAGRADE | N-HEXADECYL-B-D-MALTOSIDE, ANAGRADE |
| CYMAL ®-2, ANAGRADE | N-HEXYL-B-D-GLUCOSIDE, ANAGRADE |
| CYMAL ®-3, ANAGRADE | N-HEXYL-B-D-MALTOSIDE, ANAGRADE |
| CYMAL ®-4, ANAGRADE | N-NONYL-B-D-GLUCOSIDE, ANAGRADE |
| CYMAL ®-5, ANAGRADE | N-NONYL-B-D-GLUCOSIDE, SOL-GRADE |
| CYMAL ®-5, SOL-GRADE | N-NONYL-B-D-GLUCOSIDE-LA, ANAGRADE |
| CYMAL ®-6, ANAGRADE | N-NONYL-B-D-MALTOSIDE, ANAGRADE |
| CYMAL ®-6, ANAGRADE-LOW ALPHA | N-NONYL-B-D-THIOGLUCOSIDE, ANAGRADE |
| CYMAL ®-6, SOL-GRADE | N-NONYL-B-D-THIOMALTOSIDE, ANAGRADE |
| CYMAL ®-7, ANAGRADE | N-OCTYL-A-D-GLUCOSIDE-HA, ANAGRADE |
| CYMAL ®-7, SOL-GRADE | N-OCTYL-B-D-GALACTOSIDE, ANAGRADE |
| CY-TRIPGLU | N-OCTYL-B-D-GLUCOSIDE, ANAGRADE |
| DECYLDIMETHYLAMINEOXIDE, ANAGRADE | N-OCTYL-B-D-GLUCOSIDE, SOL-GRADE |
| DECYLDIMETHYLGLYCINE, ANAGRADE | N-OCTYL-B-D-MALTOSIDE, ANAGRADE |
| DEOXYCHOLIC ACID, SODIUM SALT | N-OCTYL-B-D-MALTOSIDE, SOL-GRADE |
| DIMETHYLHEPTYL-B-D-MALTOSIDE | N-OCTYL-B-D-THIOGLUCOSIDE, ANAGRADE |
| DMPC | N-OCTYL-B-D-THIOGLUCOSIDE-LA |
| DMPG SODIUM SALT | N-OCTYL-B-D-THIOMALTOSIDE, ANAGRADE |
| DODECYLDIMETHYLAMINEOXIDE SOL-GRADE | N-OCTYL-D17-B-D-GLUCOPYRANOSIDE |
| DODECYLDIMETHYLAMINEOXIDE, ANAGRADE | N-OCTYL-D17-B-D-GLUCOPYRANOSIDE-D7 |
| DODECYLDIMETHYLGLYCINE, ANAGRADE | NONIDET P40 SUBSTITUTE |
| DODECYLDIMETHYLGLYCINE, SOL-GRADE | N-TETRADECYL-B-D-MALTOSIDE, ANAGRADE |
| DTT, CLELAND'S REAGENT | N-TETRADECYL-N-N-DIMETHYLGLYCINE |
| DTT, CLELAND'S REAGENT, ANAGRADE | N-TRIDECYL-B-D-MALTOSIDE, ANAGRADE |
| FLUORO-FOS CHOLINE 8 | N-TRIDECYL-B-D-MALTOSIDE, SOL-GRADE |
| FLUORO-OCTYL MALTOSIDE | N-TRIDECYL-B-D-MALTOSIDE-LA |
| FOS-CHOLINE-10, ANAGRADE | N-UNDECYL-A-D-MALTOSIDE, ANAGRADE |
| FOS-CHOLINE-10, SOL-GRADE | N-UNDECYL-B-D-MALTOSIDE, ANAGRADE |
| FOS-CHOLINE-11, ANAGRADE | N-UNDECYL-B-D-MALTOSIDE, SOL-GRADE |
| FOS-CHOLINE-11, SOL-GRADE | N-UNDECYL-B-D-THIOMALTOSIDE |
| FOS-CHOLINE-12, ANAGRADE | N-UNDECYL-N-N-DIMETHYLAMINE-OXIDE |
| FOS-CHOLINE-12, DEUTERATED | PH-TRIPGLU |
| FOS-CHOLINE-12, SOL-GRADE | PLURONIC F-127 |
| FOS-CHOLINE-13, ANAGRADE | PLURONIC F-68 |
| FOS-CHOLINE-13, SOL-GRADE | PMAL ®-C12 |
| FOS-CHOLINE-14, ANAGRADE | PMAL ®-C16 |
| FOS-CHOLINE-14, DEUTERATED | PMAL ®-C8 |
| FOS-CHOLINE-14, SOL-GRADE | SODIUM CHOLATE, ANAGRADE |
| FOS-CHOLINE-15, ANAGRADE | SODIUM CHOLATE, SOL-GRADE |
| FOS-CHOLINE-15, SOL-GRADE | SODIUM DODECYL SULFATE |
| FOS-CHOLINE-16, ANAGRADE | SODIUM LAUROYL SARCOSINE, ANAGRADE |
| FOS-CHOLINE-16, SOL-GRADE | SODIUM LAUROYL SARCOSINE, SOL-GRADE |
| FOS-CHOLINE-8, ANAGRADE | SODIUM TAUROCHOLATE, ANAGRADE |
| FOS-CHOLINE-8, SOL-GRADE | SUCROSE MONODODECANOATE, ANAGRADE |
| FOS-CHOLINE-9, ANAGRADE | TETRADECYL-B-D-MALTOSIDE, SOL-GRADE |
| FOS-CHOLINE-9, SOL-GRADE | TETRADECYLDIMETHYLAMINE OXIDE |
| FOS-CHOLINE-ISO-11, ANAGRADE | TETRADECYLTRIMETHYL-AMMONIUMCHLORIDE |
| FOS-CHOLINE-ISO-9, ANAGRADE | TRITON X-100 |

TABLE 1-continued

| Non-Limiting List of Exemplary Detergents | |
|---|---|
| FOS-CHOLINE-UNSAT-11-10, ANAGRADE | TRITON X-114 |
| FOS-MEA-10, ANAGRADE | TWEEN 20 |
| FOS-MEA-12, ANAGRADE | TWEEN 40 |
| FOS-MEA-8, ANAGRADE | TWEEN 80 |
| W-UNDECYLENYL-B-D-MALTOSIDE | UNDECYL-B-D-MALTOSIDE-LA, ANAGRADE |

Various types of alcohols may be employed in the present cleaning compositions. For instance, saturated alcohols, unsaturated alcohols, acetylenic alcohols and sulfated alcohols may be utilized in the present compositions. Branched chain alcohols which may optionally be incorporated into the present compositions include monomethylated alcohols, polyisoprenoid alcohols, and phenolic alcohols and the like and combinations and mixtures thereof. Particularly, any $C_1$ to $C_8$ alcohol, linear or branched, substituted or unsubstituted, may be useful in the present compositions and methods.

Bases and/or buffers which are useful in the present compositions and methods include, but are not limited to, for example, the family of alkali metal bases. The base of the cleaning composition may be selected from ammonium or alkali metal (sodium, potassium, magnesium and the like) bases and bases comprising phosphate, carbonate, bicarbonate, and/or borate, combinations thereof and mixtures thereof. For instance, exemplary bases include, but are not limited to, TRIS, sodium phosphate, potassium borate, ammonium bicarbonate, and the like and combinations and mixtures thereof. The bases may be utilized in their hydrated salt forms, at any suitable level of hydration which achieves optimal results.

Detergents may be included in a stock solution of cleaner composition at a concentration of between about 0% to 30% weight/volume (w/v). In alternative embodiments, the detergent may comprise about 5% to 25% w/v. Embodiments also include compositions which comprise a stock solution containing about 2% to 5% w/v detergent. The stock cleaner solution also includes an alkali metal base at a concentration of about 0% to 30% w/v. Alternatively, the cleaning composition may comprise alkali metal base at a concentration of 0% to 20% w/v, 0% to 10% w/v, or 0% to 5% w/v. The stock cleaning solution composition also includes an alcohol, which may comprise up to about 0% to 100% w/v of the composition, or 0% to 70% w/v, or 0% to 35% w/v. For example, an exemplary composition may be comprised of 5% w/v detergent, between 3% and 5% alkali metal base, and between about 30% to 40% w/v alcohol, such as a short chain alcohol, in an aqueous solution.

This stock solution of cleaning composition may then be spiked into other solutions utilized to solubilize aliphatic acids and to remove contaminating aliphatic acids from parts and surfaces or to prevent the build-up of foam in reaction vessels and the like. For instance, the cleaning compositions described herein may used "neat" or without dilution, or may be added to a larger cleaning-type composition in dosages which achieve the desired result. Dosages which achieve the most desirable result upon dilution may be empirically determined.

For instance, an aqueous solution into which the present cleaning compositions may be spiked, may be comprised of such components as water, one or more surfactants or defoamers, one or more preservatives such as bacteriostatic agents known in the art, one or more hydrating agents, one or more perfumes or fragrance chemicals, and one or more viscosity agents, one or more lubricants, and mixtures thereof and the like. Other compatible surfactants which may be employed simultaneously with the present cleaning compositions may include, for instance, various amphoteric such as heloxyl and betaine compounds, the laureth family of surfactants, and the caprylyl/lauryl pyrrolidone family of surfactants, and the like and combinations and mixtures thereof. Other surfactants include, but are not limited to, for instance, polysorbates (TWEEN™), sodium dodecyl sulfate (sodium lauryl sulfate), lauryl dimethyl amine oxide, cetyltrimethylammonium bromide (CTAB), polyethoxylated alcohols, polyoxyethylene sorbitan, octoxynol (TRITON X100™), N,N-dimethyldodecylamine-N-oxide, hexadecyltrimethylammonium bromide (HTAB), polyoxyl 10 lauryl ether, BRIJ 721™, bile salts (sodium deoxycholate, sodium cholate), polyoxyl castor oil (CREMOPHOR™), nonylphenol ethoxylate (TERGITOL™), cyclodextrins, lecithin, methylbenzethonium chloride (HYAMINE™), and mixtures thereof and combinations thereof and the like.

In other words, the present cleaning compositions may be added to other compositions already present in the market designed to clean or otherwise decontaminate machine parts or surfaces. For instance, reaction vessels, brewing vessels, chemical handling machinery and the like may be contaminated with aliphatic acids and require removal of such contaminants prior to continuing operations with the reaction vessels and/or machine parts. There exist today various cleaning solutions designed to achieve this task with more or less success. However, such solutions may be ineffective in most instances, in which case addition of the presently described compositions at varying quantities and concentrations empirically determined to yield optimum removal of contaminants is most beneficial.

In another embodiment, the present compositions may be added directly to a reaction vessel or preparatory machinery as it is being used to prevent the build-up or formation of foams and/or to prevent the clogging of machine parts caused by contaminating aliphatic acids that may be left behind on chamber walls, reaction vessel walls, machine parts and the like after their use.

In a further embodiment, the present compositions may be used "neat" or in undiluted form to wash, either by spraying or otherwise immersing, contaminated parts and surfaces to remove and/or otherwise solubilize and wash away contaminating aliphatic acids. The present compositions are aqueous and thus may be sprayed on or maintained in trays or bins or tanks into which contaminated parts, machinery or other surfaces may be immersed for a period of time, optionally followed by agitation or other scrubbing mechanisms, optionally using brushes or other mechanical means to rub or otherwise contact the parts, machinery or other surfaces, thereby removing the contaminating aliphatic acids. Optionally, jets or aqueous pumps with nozzles aimed at the immersed part, machinery or surfaces may be placed inside the tray, bin or tank filled with the present cleaning compositions, thereby facilitating removal of the contaminating aliphatic acids. By immersing and optionally exposing the contaminated part, machinery or surface to one or more immersed aqueous pumps with nozzles designed to push the cleaning solution towards the contaminated entities at various velocities, optimal decontamination may be achieved.

Alternatively, the present compositions may be fed through a hose or other means with which to spray the present compositions onto contaminated surfaces, parts or machinery and the like. The spray velocity may be adjusted to achieve optimum results of removal of the contaminating aliphatic acids. In other words, use of a higher or lower velocity spray may be called for, optionally with one or more spray jets pointed directly or indirectly at the contaminated parts, machinery or surfaces, for an empirically determined period of time, may achieve the desired decontamination results.

Optionally, when the part or machinery to be decontaminated is complex or contains many interior chambers, parts, gears or other pieces, it may be suitable to inject the cleaning solution into the contaminated equipment. For instance, if the contaminated equipment is a pump or agitator made of metal with many parts, which typically are designed to hold a certain volume of solution, the present cleaning composition may be added directly to that pump or agitator in substitution for the normal use solution, the instrument then turned on and allowed to operate with the present cleaning compositions thereby decontaminating the machinery.

Other mechanical means of dislodging contaminates may optionally be employed, such as, but not limited to, agitation, sonication, mechanical abrasion, rotation, buffing, shaking, scrubbing, and the like. Further, the present cleaning compositions may be employed at any optimal temperature. By optimal temperature is meant any temperature between 0° C. and 100° C., so long as the present cleaning compositions do not freeze or boil. An advantageous feature of the present cleaning solutions includes the high boiling point of the cleaning solution. In other words, the present cleaning solutions are not caustic and do not evaporate to a significant amount in normal or room temperature applications. Thus, by adjustment of the amount of alcohol and/or water used to generate the present cleaning compositions, the compositions may be employed at any empirically determined optimal temperature.

Further, the present cleaning compositions may be applied by any means which yields optimal results. Thus, the present cleaning compositions are easily manipulated and amenable to various application modes such as pressurized spraying, misting, fogging, sonication, and the like.

The present cleaning compositions may be useful and applied in a wide variety of conditions and situations in industry, academia, government settings and in personal use. While it would be impossible to list every single setting in which the present cleaning compositions and methods could be applied, a non-limiting list of such environments may include, for instance, methods for producing detergents, pharmaceuticals, consumer products, coring and core analysis, oils, fuels, fermentation, emollients, moisturizers, liquors, foods such as seafood, milk, butter and other dairy products, water processing, paper products, and the like. The present compositions may be useful in the process of manufacturing such items as consumer products, such as gels, soaps, or other fluids, including moisturizers, shaving gels, hair treatment gels, sunscreen, pain relief creams, facial creams, toothpaste, deodorants, hand sanitizers, and the like. Essentially any manufacturing process or action which exposes machine parts, surfaces, equipment, and the like to the presence of contaminating aliphatic acids, may present a situation in which the present cleaning compositions may be usefully and advantageously employed to clean these items at low cost and in an efficient and non-toxic manner.

For instance, as a non-limiting example, when sonicating a sample containing bacterial or other living cells, the sonicator tip must be cleaned to remove lipophilic and aliphatic acid contaminants. A second sonication step in the presence of the present compositions will effectively eliminate such contaminants from the sonicator tip. As a further example, when shaving using an electric razor, the electric razor may be exposed to aliphatic acid contaminants and require cleaning prior to further use. Known and presently available cleaning solutions designed to remove other contaminants may be ineffective or completely useless in addressing the issue of removal of aliphatic acid contaminants. Use, or addition, of the presently described compositions will completely eliminate and remove all aliphatic acid contaminants from such a device.

As another non-limiting example, during the fermentation process in making beer or wine, yeast cells must be handled and removed in some instances, thereby eliminating all microorganisms from the finished product. The vats, pumps, tubing, pipes, filters and other machinery used in the brewing process requires cleaning to remove lipid and aliphatic acid-type contaminants. The presently described compositions and methods address this need by providing a surprisingly effective decontaminating alternative which is simple, inexpensive, non-toxic and non-caustic. In biotechnology research and manufacturing, pharmaceutical research and manufacturing, environmental testing, and like situations, chromatographic columns are often employed to separate contaminants from the desired end product and analyte. The pumps, tubes, pistons, columns, collection flasks, and other devices must be cleaned of all contaminants after use and between sample processes. Again, the presently described methods and compositions will accomplish elimination of aliphatic contaminants in at least this situation. There are columns available on the market that are specifically designed to separate and analyze aliphatic acids, which also can be effectively cleaning of all contaminants with the presently described compositions and methods.

Additional non-limiting examples of settings in which the present compositions and methods may be useful and applied with success for removing contaminant aliphatic acids includes research and manufacture in the cosmetic and pharmaceutical fields. Many cosmetic products include aliphatic acids. Many pharmaceutical agents are made from or include aliphatic acids of various types. Both during small-scale research operations and large-scale mass production, aliphatic acids can contaminate equipment, surfaces, machinery, analysis instruments and the like. The present compositions and methods are effective in these settings in eliminating remnant aliphatic acid contaminates from such expensive and important items as a cleaning step between use. (See, for instance, Gatti et al., "Analysis of aliphatic dicarboxylic acids in pharmaceuticals and cosmetics by liquid chromatography (HPLC) with fluorescence detection," *J. Pharmac. Biomed. Analysis,* 13(4-5):589-595, 1995, and references cited therein, Opala et al., "The effect of valproic acid on plasma carnitine levels," *Am. J. Dis. Child.,* 145(9):999-1001, 1991, and U.S. Pat. No. 5,405,617, each of which is incorporated herein by reference in its entirety for all purposes).

Additionally, the present cleaning compositions and methods may be useful in the biotechnology field. That is, any scientific research requiring, for example, the handling and manipulation of tissue culture apparatus, disposables and flasks, and the like, may be cleaned using the present compositions. Further processing, for instance by autoclave or other sterilization technique, may optionally follow or precede cleaning with the present compositions. Plastics, stainless steel, rubber, and other surface types may all be cleaned of aliphatic acid residues left behind by biological and/or cellular samples using the cleaning compositions described herein. The cleaning compositions presently described are non-caustic and therefore may be contained in a rinse bottle or spray bottle with a small spout, commonly employed in laboratory and clinical settings, so that various devices may be rinsed with the present compositions. Hospitals may find the present cleaning compositions particularly helpful in cleaning various hospital equipment for reuse, such as, for instance, bedpans, implantable devices, intravenous lines, and the like.

Particularly useful exemplary cleaning compositions include, but are not limited to, compositions comprising a short chain alcohol, a detergent such as n-dodecyl-N,N-dimethylamine-N-oxide and TRIS base. The short chain alcohol may, for instance, be methanol, ethanol, isopropyl alcohol, butanol, propanol, heptanol, isobutanol or a combination or mixture thereof. This exemplary composition may comprise alcohol at a concentration of about 33.5% w/v, detergent at a concentration of about 5% w/v and base at a concentration of about 3.35% w/v. Additional exemplary embodiments may be found in the following Examples.

EXAMPLES

It is understood that the examples and embodiments described herein are for illustrative purposes only and that various modifications or changes in light thereof will be suggested to persons skilled in the art and are to be included within the spirit and purview of this application and scope of the appended claims. Accordingly, the following examples are offered to illustrate, but not to limit, the claimed invention.

Example 1

Different detergent or detergent/base stock solutions were mixed in culture tubes, vortexed for 1 minute, and allowed to completely dissolve over an additional 30 minutes. The stock solutions were either used undiluted or diluted with additional water or alcohol in predetermined ratios. Diluted solutions were again mixed by vortexing for 1 minute and then allowing the solution to sit for 30 minutes.

A representative aliphatic acid, the fatty acid stearic acid, was added to the tube in a predetermined quantity between 10 mg/ml and 20 mg/ml. The solution was maintained at 40° C. for 12-18 hours and then visually inspected to qualitatively assign the solubility profile. Solutions were then cooled to room temperature (RT) and after 6 hours, they were evaluated again for evidence of precipitation. The detergents examined and their sources are shown in Table 2. Where the detergent is available from more than one source, multiple sources are provided. Other identifying information is as follows: ANATRACE® (Maumee, Ohio), USB® (Cleveland, Ohio), Young Chemical Co. (Twinsburg, Ohio), Nanjing ROBIOT® (Nanjing, China), COGNIS® (Cincinnati, Ohio), INALCO® (San Luis Obispo, Calif.), and UNIVAR® (San Jose, Calif.).

TABLE 2

| Detergents and Source | |
|---|---|
| 1. CHAPS | USB ®/HOPAX ® |
| 2. C-14 trimethyl ammonium chloride | ROBIOT ® |
| 3. C-12 dimethyl amine oxide | Young Chemical |
| 4. C-12 dimethyl glycine | ANATRACE ® |
| 5. C-12 amido dimethylpropyl amine oxide | COGNIS ® |
| 6. C-16 trimethyl ammonium chloride | ROBIOT ® |
| 7. C-12 iminodipropionic acid, monosodium salt | COGNIS ® |
| 8. Dodecyl maltoside | ANATRACE ® |
| 9. Decyl maltoside | ANATRACE ® |
| 10. Octyl glucoside | INALCO ® |
| 11. Triton X-100 | USB/UNIVAR ® |
| 12. Tween 80 | USB/UNIVAR ® |
| 13. $C_8E_6$ | ANATRACE ® |
| 14. PMAL-12 | ANATRACE ® |

In Table 3, below, results are provided showing solubility of stearic acid added to the solutions as described above. Detergents classified as ionic and non-ionic were tested, as well as carbohydrate and polyethylene glycol based non-ionic detergents. Partial solubility upon incubation at 40° C. overnight (indicated by the letter "a") is indicated for most of the detergents selected for analysis. Complete solubility at all concentrations of added stearic acid upon incubation overnight at 40° C. (indicated by the letter "b") was observed for only one detergent, C-12 dimethyl amine oxide.

TABLE 3

Preliminary Screening of Detergents (no agitation)

| Entry No. | Detergent (SOLN I - 100 mg/ml aqueous or 10% w/v) | Concentration of Stearic Acid in Solution 10 mg/ml | 15 mg/ml | 20 mg/ml |
|---|---|---|---|---|
| | Ionic surfactants | | | |
| 1. | CHAPS | a | a | a |
| 2. | C-14 trimethyl ammonium chloride | a | a | a |
| 3. | C-12 dimethyl amine oxide | b | b | b |
| 4. | C-12 dimethyl glycine | a | a | a |
| 5. | C-12 amido dimethylpropyl amine oxide | a | a | a |
| 6. | C-16 trimethyl ammonium chloride | a | a | a |
| 7. | C-12 iminodipropionic acid, monosodium salt | a | a | a |
| | Non-ionic surfactants Carbohydrate based | | | |
| 8. | Dodecyl maltoside | a | a | a |
| 9. | Decyl maltoside | a | a | a |
| 10. | Octyl glucoside | a | a | a |
| | Polyoxyethylene glycol based | | | |
| 11. | Triton X-100 | a | a | a |
| 12. | Tween 80 | a | a | a |
| 13. | $C_8E_6$ | a | a | a |
| | Shepas Polymeric Solubilization aids | | | |
| 14. | PMAL-12 | a | a | a |

a = Partially soluble when incubated overnight at 40° C.
b = Completely soluble when incubated overnight at 40° C.

In the above experiment, it was surprisingly observed that n-dodecyl-N,N-dimethylamine-N-oxide (LDAO, CAS number 1643-20-5, also called by other names, such as dodecyldimethylamine oxide, EINECS Number 216-700-6) was the only detergent that quantitatively facilitated the solubilization of the long chain fatty acid in an aqueous environment. In the above experiment, it was observed that 4 parts surfactant could dissolve 1 part stearic acid.

Example 2

The following experiment is similar to Experiment 1, except that addition of a non-toxic buffer and/or a short-chained alcohol was investigated to attempt to improve upon the above results. Various bases and alcohols were tested. Table 4, below, provides a representative data set displaying the desirable properties of a non-toxic solution of detergent, water, base and alcohol. A representative non-toxic base, TRIZMA® (SIGMA-ALDRICH®, St. Louis, Mo.), was first tested (also known as TRIS, and Tris(hydroxymethyl)aminomethane). The theory was that addition of a base might increase the ionic behavior of stearic acid in an aqueous environment by deprotonating the acidic proton of the acid. The experimental results of are as provided in Table 4. The letter "a" indicates no solubility was observed after about 12 hours incubation at 40° C. The letter "b" indicates complete solubility of the added stearic acid at 100 mg/ml after about 12 hours incubation at 40° C. For this test, the amount of contaminating aliphatic acid, stearic acid, added to the solution was increased to 100 mg/ml.

TABLE 4

Addition of Non-Toxic Base and Alcohol

| | Concentration of TRIZMA ® | Solubility of stearic acid at 100 mg/ml |
|---|---|---|
| 1. | 10% w/v in water | a |
| 2. | 10% w/v in 10% aqueous 2-propanol | a |
| 3. | 10% w/v in 50% aqueous 2-propanol | a |
| 4. | 6.7% w/v in 67% aqueous 2-propanol | b |
| 5. | 0% w/v in 67% aqueous 2-propanol | a |

a = No solubility after about 12 hrs at 40° C.
b = Completely soluble after about 12 hrs at 40° C.

The results displayed in Table 4 clearly indicate that the combination of both a base and an alcohol was unexpectedly superior in facilitating the solubilization of the contaminating stearic acid. The most positive result came from entry 4 (Table 4) where up to 100 mg/ml, or 10% steric acid, was completely solubilized in 6.7% TRIZMA® in 67% aqueous 2-propanol (IPA). The alcohol not only increased the solubility of ionized stearic acid in water, but also greatly reduced the foaming effect observed in the aqueous environment. IPA was utilized as the first choice for an alcohol because it has very low volatility at 40° C. and is considered to be non-toxic; however, other non-volatile alcohols such as, but not limited to, n-butanol or s-butanol, may provide similar results.

Example 3

Upon obtaining the results provided above, it was surmised that perhaps the increased ionic character of the aqueous media, reduced surface tension from the surfactant, increased ionic character of the fatty acid by the base, and the presence of an alcohol to reduce foaming would provide exemplary results. Further testing of these variables yields the data shown in Table 5, below. Tests were performed as described above in Example 1, except that the concentrations of the various chemicals are as identified in the second column. The term "D.I. water" stands for deionized water. The letter "a" is meant to indicate complete solubility of the added stearic acid contaminant when incubated at 40° C. for about 12 hours. The letter "b" is meant to indicate formation of an undesirable precipitate was observed once the solution was returned to room temperature after about a 12 hour incubation at 40° C. The letter "c" indicates that only partial solubilization was observed after incubation for about 12 hours at 40° C. Where two letters are indicated in Table 4, the first letter is the observation after incubation at 40° C., and the second letter is the observation of the solution made after returning the solution to room temperature. The quantity of contaminating aliphatic acid, stearic acid in this experiment, added to the solutions was between 115 and 225 mg/ml.

TABLE 5

Synergistic Effect of the Detergent and Base

| | | Solubility of stearic acid (mg/ml) | | | |
|---|---|---|---|---|---|
| Entry | Concentration of additives | 115 | 140 | 180 | 225 |
| 1. | TRIZMA ® (6.7% w/v)<br>C-12 dimethyl amine oxide (5.0% w/v)<br>2-propanol (67.0%)<br>D.I. water (33.0%) | a | a | a, b | a, b |
| 2. | TRIZMA ® (3.35% w/v)<br>C-12 dimethyl amine oxide (2.5% w/v)<br>2-propanol (33.5%)<br>D.I. water (66.5%) | a, b | c | c | c |
| 3. | TRIZMA ® (3.35% w/v)<br>C-12 dimethyl amine oxide (5.0% w/v)<br>2-propanol (33.5%)<br>D.I. water (66.5%) | a | a | a, b | b, c |
| 4. | TRIZMA ® (6.7% w/v)<br>C-12 dimethyl amine oxide (5.0% w/v)<br>2-propanol (33.5%)<br>D.I. water (66.5%) | a | a | a, b | a, b |

a = Completely soluble after about 12 hrs at 40° C.
b = Precipitates after brought back to room temperature.
c = Partially soluble after about 12 hrs at 40° C.

As empirically determined, the simultaneous use of the detergent and the base significantly facilitates the solubility of stearic acid up to 225 mg/ml (22.5% w/v) especially when compared to that provided individually by the detergent LDAO at 20 mg/ml (2% w/v) and the TRIZMA base at 100 mg/ml (10% w/v). This surprising result indicates there may be a synergistic behavior between the two species. Preferred solutions were provided by entry 1 and entry 4 in Table 5. These two solutions differ only in the percentage of aqueous IPA, where the 33% and 67% solutions seem to work identically with 6.7% TRIZMA and 5% LDAO.

While these results may be further optimized, it is clear that an aliphatic acid contaminant present in an aqueous solution as a foam can be surprisingly, effectively solubilized with the above indicated non-toxic solutions of water, base, alcohol and detergent. It is believed that various other detergents, bases and alcohols, when tested at varying concentrations, may achieve similar results.

While the foregoing invention has been described in some detail for purposes of clarity and understanding, it will be clear to one skilled in the art from a reading of this disclosure that various changes in form and detail can be made without departing from the true scope of the invention. All publications, patents, patent applications, and/or other documents cited in this application are incorporated by reference in their entirety for all purposes to the same extent as if each individual publication, patent, patent application, and/or other document were individually indicated to be incorporated by reference for all purposes.

Example 4

Additional tests were performed to measure the effects of changing the pH and the type of alcohol used in the tests.

These tests were performed using the same methods provided in Example 1, above. Again, the goal was to increase the solubility capacity of the solutions for fatty acids such as the model compound used, steric acid. Several different alcohols were investigated as well as different pH ranges. The pH was adjusted using environmentally benign or non-toxic chemicals, such as, for instance, citric acid. In the example, citric acid was used to adjust the pH. The amount of citric acid (or HCl as in one example) is provided in the third column labeled "Adjustment/g/100 ml" solution. For instance, the second isopropyl alcohol (IPA) sample had added to it citric acid in the amount of 0.84 g/100 ml. The effects of adding ethylenediaminetetraacetic acid (EDTA) was also tested in the last sample. The last column, labeled "Max mg/ml" provides the maximum amount of stearic acid that was able to be completely dissolved by the various sample solutions, measured in mg stearic acid per ml of solution. Table 6 provides results of the tests:

TABLE 6

Stearic Acid Solubility Dependency on pH and Alcohol

| Alcohol | pH | Adjustment/ g/100 ml | Max mg/ml |
|---|---|---|---|
| IPA | 10.2 | none | 250-300 |
| IPA | 9 | Citric acid/0.84 | 250 |
| IPA | 8.5 | Citric acid/2.0 | 180 |
| IPA | 8 | Citric acid/3.04 | 140 |
| IPA | 8 | HCl | 140 |
| n-Propanol | 10.2 | none | 300-400 |
| n-Propanol | 9 | Citric acid/0.67 | 250 |
| n-Propanol | 8.5 | Citric acid/1.69 | 225 |
| n-Propanol | 8 | Citric acid/2.74 | 180 |
| n-Butanol | 10.2 | none | <225 |
| IPA | 8.5 | EDTA/2.24 | 225 |

While it was somewhat expected that a change in pH would alter the solubility capacity of the solutions, the results also revealed that a simple switch from IPA to n-propanol yielded an unexpected result of much higher ability to dissolve the fatty acid. The solubility of stearic acid in IPA along at pH 10.2 was only 250 to 300 mg/ml whereas in n-propanol, at the same pH, it was 300 to 400 mg/ml. Dropping the pH in both solutions yielded similar solubility parameters for the fatty acid.

In other examples, not shown here, other additives were included in the solutions which acted as, for example, lubricants or bacteriostatic agents. Lubricant additives can be important to allow for processing through machinery on a large scale. Additionally, the goal was to stick with reagents that were bacteriostatic in nature, so that the solutions could be stored for predictable long periods of time without worry of bacterial contamination. Various lubricants, such as glycerol and the like, are known in the art as are various bacteriostatic agents.

What is claimed is:

1. A non-toxic or environmentally benign cleaning solution consisting of: 1% to 10% (w/v) base; 30% to 70% (w/v) a primary or secondary unsubstituted alcohol; 1% to 10% (w/v) n-dodecyl-N,N-dimethylamine-N-oxide; and water, wherein the solution has a pH of between 8 and 10.2.

2. The cleaning solution according to claim 1, wherein the base is selected from the group consisting of: ammonium bases, alkali metal bases, and mixtures thereof.

3. The cleaning solution according to claim 1, wherein the base has a species selected from the group consisting of: phosphate, carbonate, bicarbonate, borate, sodium, potassium, ammonium, and mixtures thereof.

4. The cleaning solution according to claim 1, wherein the alcohol is selected from the group consisting of: isopropyl alcohol, n-propanol, butanol, and isobutanol.

5. The cleaning solution according to claim 1, wherein the alcohol is isopropyl alcohol and the base is tris.

6. The cleaning solution according to claim 1, wherein the percent alcohol present in the cleaning solution is between about 30% and 40% (w/v).

7. The cleaning solution according to claim 1, wherein the percent base present in the cleaning solution is between about 3% and 5% (w/v).

8. A method of eliminating or otherwise removing an aliphatic acid from an aliphatic acid-contaminated solution, which comprises adding the cleaning solution according to claim 1 to the aliphatic acid-contaminated solution.

9. The method according to claim 8, wherein the base is selected from the group consisting of: ammonium bases, alkali metal bases, and mixtures thereof.

10. The method according to claim 8, wherein the base has a species selected from the group consisting of: phosphate, carbonate, bicarbonate, borate, sodium, potassium, ammonium, and mixtures thereof.

11. The method according to claim 8, wherein the alcohol is isopropyl alcohol or n-propanol.

12. The method according to claim 8, wherein the alcohol is isopropyl alcohol and the base is tris.

13. The method according to claim 8, wherein the percent alcohol present in the cleaning solution is between about 30% and 40% (w/v).

14. The method according to claim 8, wherein the percent base present in the cleaning solution is between about 3% and 5% (w/v).

15. A method of eliminating an aliphatic acid contaminant, which comprises: providing a surface or aqueous solution which is contaminated with an aliphatic acid; and contacting the surface with, or adding to the aqueous solution, the cleaning solution according to claim 1.

16. The method according to claim 15, which further comprises: providing a second solution; adding an amount of the cleaning solution to the second solution; and contacting the surface with, or adding to the aqueous solution, the second solution.

17. The method according to claim 16, wherein the amount of the cleaning solution added to the second solution is determined empirically to achieve optimum elimination of the aliphatic contaminant.

18. The method according to claim 15, wherein the alcohol is isopropyl alcohol or n-propanol.

19. The method according to claim 16, wherein the alcohol is isopropyl alcohol and the base is tris.

20. The method according to claim 16, wherein the percent alcohol present in the cleaning solution is between about 30% and 40% (w/v).

21. The method according to claim 16, wherein the percent base present in the cleaning solution is between about 3% and 5% (w/v).

22. A non-toxic or environmentally benign cleaning composition consisting of: 1% to 4% (w/v) alkali metal base; 30% to 35% (w/v) primary or secondary unsubstituted alcohol of a length between $C_1$ and $C_8$; 1% to 5% (w/v) n-dodecyl-N,N-dimethylamine-N-oxide; and water.

23. The cleaning composition according to claim 22, wherein the base is tris and the alcohol is isopropyl alcohol or n-propanol.

24. The cleaning composition according to claim 22, wherein the composition has a pH of between 8 and 10.2.

25. A non-toxic or environmentally benign cleaning composition consisting of: 1% to 10% (w/v) base; 30% to 70% (w/v) primary or secondary unsubstituted alcohol of a length between $C_1$ and $C_8$; 1% to 10% (w/v) n-dodecyl-N,N-dimethylamine-N-oxide; water; and at least one of glycerol, a preservative, a perfume and a fragrance.

* * * * *